US009649780B1

(12) United States Patent
Benafan et al.

(10) Patent No.: US 9,649,780 B1
(45) Date of Patent: May 16, 2017

(54) SHAPE MEMORY ALLOY ROCK SPLITTERS (SMARS)

(71) Applicant: The United States of America as represented by the Administrator of the National Aeronautics and Space Administration, Washington, DC (US)

(72) Inventors: Othmane Benafan, Fairview Park, OH (US); Ronald D. Noebe, Medina, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 86 days.

(21) Appl. No.: 14/709,907

(22) Filed: May 12, 2015

Related U.S. Application Data

(60) Provisional application No. 61/993,622, filed on May 15, 2014.

(51) Int. Cl.
*B28D 1/32* (2006.01)

(52) U.S. Cl.
CPC ..... *B28D 1/327* (2013.01); *B28D 1/322* (2013.01)

(58) Field of Classification Search
CPC ..... B28D 1/327; B28D 1/322
USPC ..... 125/23.01
See application file for complete search history.

(56) References Cited

U.S. PATENT DOCUMENTS

| | | | | |
|---|---|---|---|---|
| 1,719,257 A * | 7/1929 | Booth | B28D 1/221 219/200 |
| 3,580,637 A | 5/1971 | Itoh et al. | |
| 4,740,036 A * | 4/1988 | Cerny | E21C 37/16 125/23.01 |
| 5,012,649 A | 5/1991 | Chevakin et al. | |
| 5,024,388 A * | 6/1991 | Kaneko | E21C 37/00 125/23.01 |
| 7,624,797 B2 * | 12/2009 | Fay | F03G 7/065 166/134 |

FOREIGN PATENT DOCUMENTS

| | | |
|---|---|---|
| CN | 101726223 | 6/2010 |
| CN | 201520012 U | 7/2010 |
| SU | 1153061 A1 | 4/1985 |

* cited by examiner

*Primary Examiner* — Robert Rose
(74) *Attorney, Agent, or Firm* — Robert H. Earp, III

(57) ABSTRACT

Shape memory alloys (SMAs) may be used for static rock splitting. The SMAs may be used as high-energy multifunctional materials, which have a unique ability to recover large deformations and generate high stresses in response to thermal loads.

19 Claims, 21 Drawing Sheets

200

500

500

600

600

600

600

1100

1200

1300

1400

1500

1600

SHAPE MEMORY ALLOY ROCK SPLITTERS (SMARS)

CROSS-REFERENCE TO RELATED APPLICATION

This application claims the benefit of U.S. Provisional Patent Application No. 61/993,622, filed on May 15, 2014. The subject matter thereof is hereby incorporated herein by reference in its entirety.

ORIGIN OF THE INVENTION

The invention described herein was made by employees of the United States Government and may be manufactured and used by or for the Government for Government purposes without the payment of any royalties thereon or therefore.

FIELD

The present invention relates to rock splitters, and, more particularly, to a non-explosive process for fracturing planetary rocklike materials and minerals.

BACKGROUND

Solar system exploration has been reliant on state-of-the-art space technologies ranging from navigation systems to propulsion systems, and also, to scientific instruments. These missions often require close contact with planetary bodies, such as the moon, planet Mars, asteroids and comets, where in-situ environmental sampling is sought. In these cases, scientific instruments are built to detect, collect, and characterize samples from the atmosphere, dust particles, soil, rock samples, or aeolian deposits, for example. This provides researchers with geologic and climate history for a better understanding of near-Earth planets, asteroids, and the evolution of the objects as a whole.

Based on revolutionary discoveries by previous missions, it is of interest not only to analyze matter on the planetary bodies, but also to return the soil and rock samples to Earth for more detailed studies and investigations. However, limitations exist preventing large rocks, such as ledges and boulders, from being sampled. For example, limited tools allowed onboard a space vehicle or restrictions in physical space and weight or safety reasons prevent these rock formations from being sampled. In many cases, it would be beneficial to break the rock formation in the region of interest to examine the internal structures or compositions, and determine whether the region of interest is appropriate to transfer the sample back to Earth.

While rock breaking and splitting is a common task here on Earth, and is accomplished using many different methods, breaking and splitting rock outside of Earth is difficult. On Earth, dynamically, explosive and blasting methods are being used to break large rock formations in mines and drilling operations. Static methods, such as fluid pressure cells, agents, and hydraulic wedges, are also being employed. Most of these methods, however, are not suitable for space applications due to the large size and weight of the equipment used. Moreover, demolition techniques generate dust, noise, vibrations and flying debris that can interfere with the space vehicle components, such as sensors, detectors, and cameras, and pose safety concerns. Even in the case when agents and pressure fluids are used, these methods are time consuming, carry the risk of contaminating the environment, and do not guarantee chemical reactions with certain rocks, especially unknown rock structures on foreign planets. Furthermore, simply transporting the active agents for these last two processes (i.e., explosive agents and corrosive fluids) poses significant ricks for crews and spacecraft.

Thus, an alternative approach for rock splitting on foreign planets and objects may be beneficial.

SUMMARY

Certain embodiments of the present invention may provide solutions to the problems and needs in the art that have not yet been fully identified, appreciated, or solved by current rock splitting techniques. For example, a compact, reliable, non-explosive, and cost effective technique for static rock splitting using shape memory alloys (SMAs) is provided. This is demonstrated through the capability of SMAs as high-energy multifunctional materials, which have a unique ability to recover large deformations and generate high stresses in response to thermal loads. This may allow SMA rock splitter (SMARS) to become part of a basic multifunctional scientific package (e.g., robotic sampling, propping, and structure reinforcement) onboard rovers or spacecraft.

In one embodiment, an apparatus for splitting rocks includes one or more SMA expanding elements, which include nickel titanium hafnium (NiTiHf), nickel titanium zirconium (NiTiZr), or nickel titanium hafnium zirconium (NiTiHfZr). When the one or more SMA expanding elements reach a predefined temperature within a predefined borehole of the rock, the one or more SMA expanding elements may exert force on walls of the borehole for splitting the rock.

In another embodiment, a process includes determining a deformation mode of the SMA material. The process also includes based on the deformation mode, isothermally training the SMA material to a predefined strain level required to obtain a desired stress and displacement, isobaric training the SMA material to the predefined stress level, or cyclic training the SMA material to the predefined stress levels.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
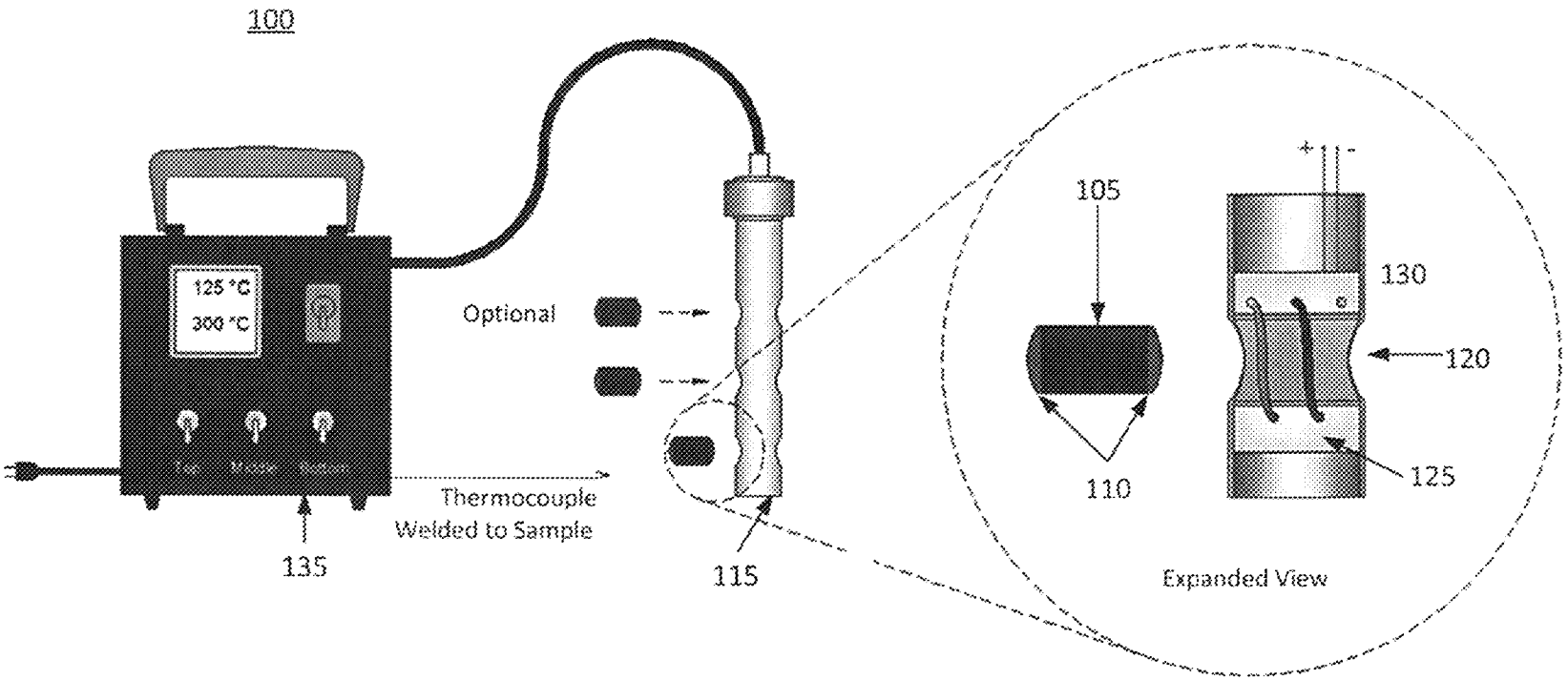
FIG. 1 is a diagram illustrating a SMARS system, according to an embodiment of the present invention.

Embodiments of the present invention pertain to the implementation of SMAs as a driving member of a non-explosive, static rock splitter device for space exploration with an extension to ground-based applications. The actuating member fabricated from SMA compositions, such as NiTiHf, NiTiZr, and other alloys with ternary and quaternary additions and specialized aging and heat treatments, may generate stresses in excess of 800 MPa, and in some embodiments, in excess of 1000 MPa. The SMAs may also have temperature capabilities of 100 degrees Celsius or more. These stresses are much higher than the stress that the commercial binary nickel titanium (NiTi) alloys generate. These high stresses allow construction of instruments based on SMA technology that are reliable for flight missions with reduced cost from launch to operation costs.

It should be appreciated that SMAs have the ability to recover large deformations and generate high stresses in response to thermal or mechanical loads. This behavior may occur by virtue of a crystallographically reversible martensitic phase transformation between a high symmetry parent austenite phase and a low symmetry martensite phase. In general, when the SMA is deformed in the martensitic condition, the induced deformation can be recovered by applying heat above certain temperature. However, as long as the critical temperature is not reached, the SMA retains the deformed condition indefinitely until actuated, i.e., heated. When the SMA is heated above the transformation temperature, but is constrained from moving, the SMA may generate extremely large forces. This high power and weight ratio characteristic makes this technology suitable for large force applications, hence SMARS.

SMARS may include SMA material that acts as the actuating member, a casing heater placed around the SMA material, and a power source to provide a current through the heaters. In some embodiments, end caps may be used for acute penetration into rocks, and in further embodiments, a hand-press may be used to reset the SMA material after each usage.

Also, in some embodiments, the SMA material may include nickel-rich (Ni-rich) compositions of ternary NiTiHf and NiTiZr. The SMA material are precipitation strengthened through metallurgical techniques involving a solution anneal or hot working above the solvus temperature. This is then followed by an aging treatment used to form the precipitate structure. The aging treatment provides strength and dimensional stability to the SMA material, while still allowing the transformation to occur. The SMA material may span from Ni-rich, heat treatable precipitation strengthened Ni—Ti—Hf and Ni—Ti—Zr alloys with 3 to 30 atomic percent hafnium (Hf) or Zirconium (Zr), or some combination thereof, in some embodiments.

The SMA material in certain embodiments may be produced by vacuum induction melting, followed by casting into ingots. The ingots may then be homogenized, i.e., heat treated at high temperature to ensure uniform composition throughout the ingot. Finally, the homogenized SMA material may then be sealed into steel cans and extruded into a rod. In some embodiments, the SMA material may be heat treated between 400° C. and 550° C. for various times to form the precipitate structure and strengthen the SMA material.

Figure 2A:
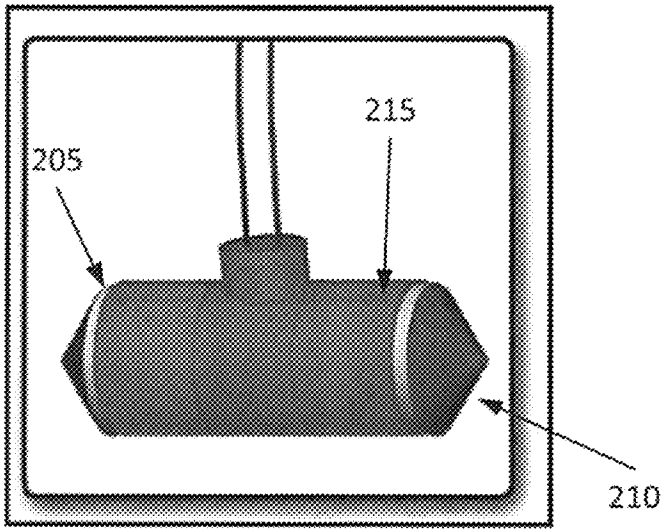
FIGS. 2A and 2B illustrate components of SMARS, according to an embodiment of the present invention.
Figure 2B:
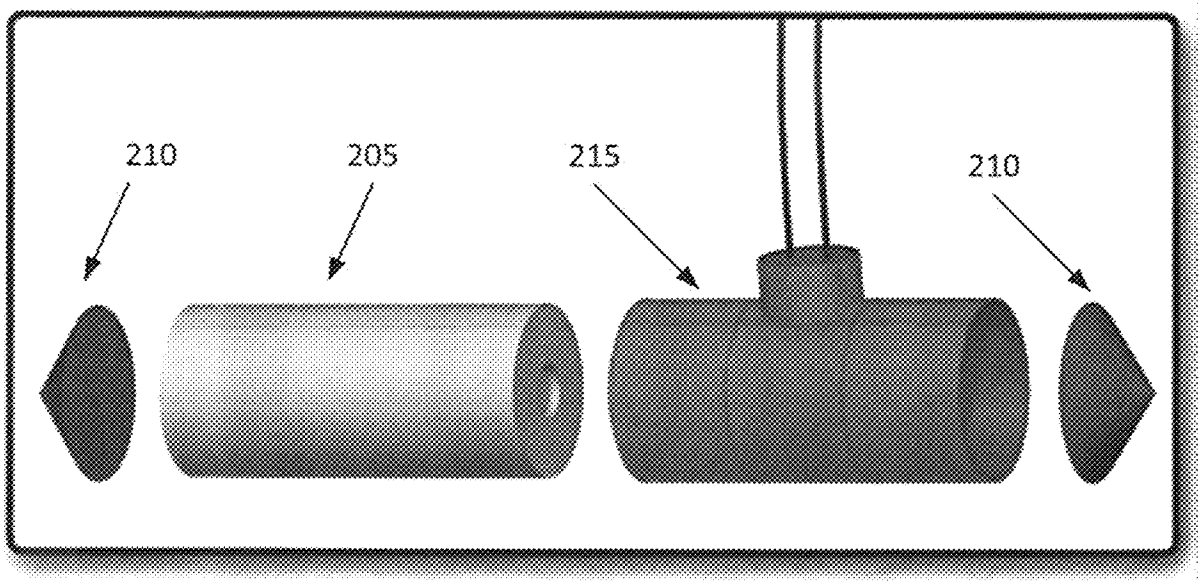

FIG. 1 is a diagram illustrating a SMARS system 100, according to an embodiment of the present invention. In FIG. 1, SMARS system 100 is configured to provide controllable rock splitting without any demolition damage to the surrounding environment. SMARS system 100 includes a SMA expanding element (hereinafter "expanding element") 105 with end caps 110. See, for example, FIGS. 2A and 2B, which illustrate components of SMARS 200, according to an embodiment of the present invention. In some embodiments, SMARS 200 includes an expanding element 205, such as an SMA, made of NiTiHf alloys, a heater 215 that fits over expanding element 205, and end caps 210 at both ends of expanding element 205. Depending on the embodiment, end caps 210 may be conical, spherical, cylindrical, helical, or flat.

Returning to FIG. 1, SMARS expanding elements 105 (i.e., the NiTiHf alloy) in the form of cylindrical pellet may be initially conditioned (or trained) to produce desirable forces upon activation. The training process of expanding elements 105 used is described in more detail below.

In order to achieve the anticipated forces and displacements necessary, several training processes may be used. The training process described herein may produce a desirable material response after performing selected mechanical, thermal, and/or thermomechanical loading. In the case of SMARS, training may attain the highest possible blocking forces (i.e., the forces generated during the constrained heating, also known as recovery forces) with the highest possible displacements. For purpose of explanation, the following training methods may be used, e.g., isothermal, isobaric, and cyclic training routines.

Figure 8:
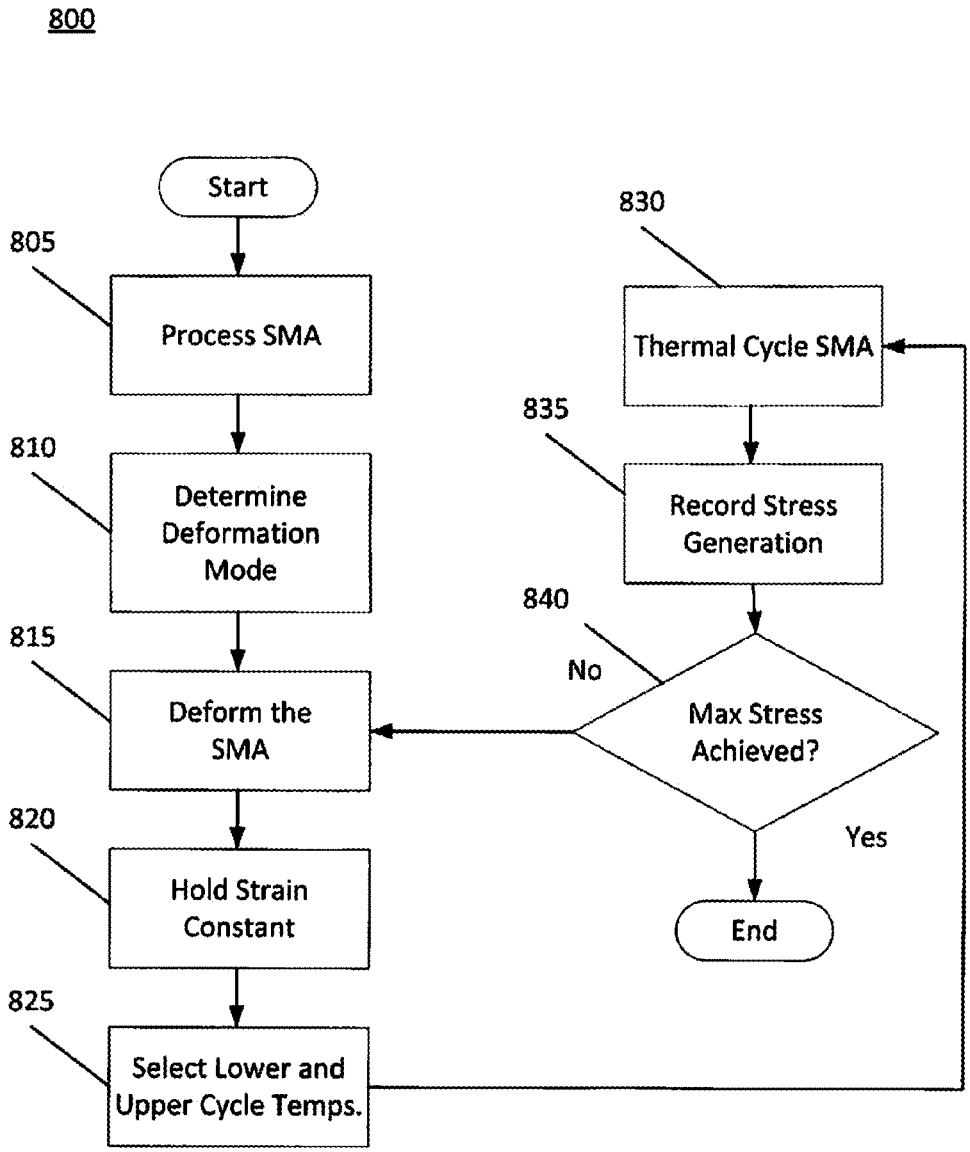
FIG. 8 is a flow diagram illustrating a process for isothermally training SMA material and verifying the stress capability, according to an embodiment of the present invention.
Figure 11:
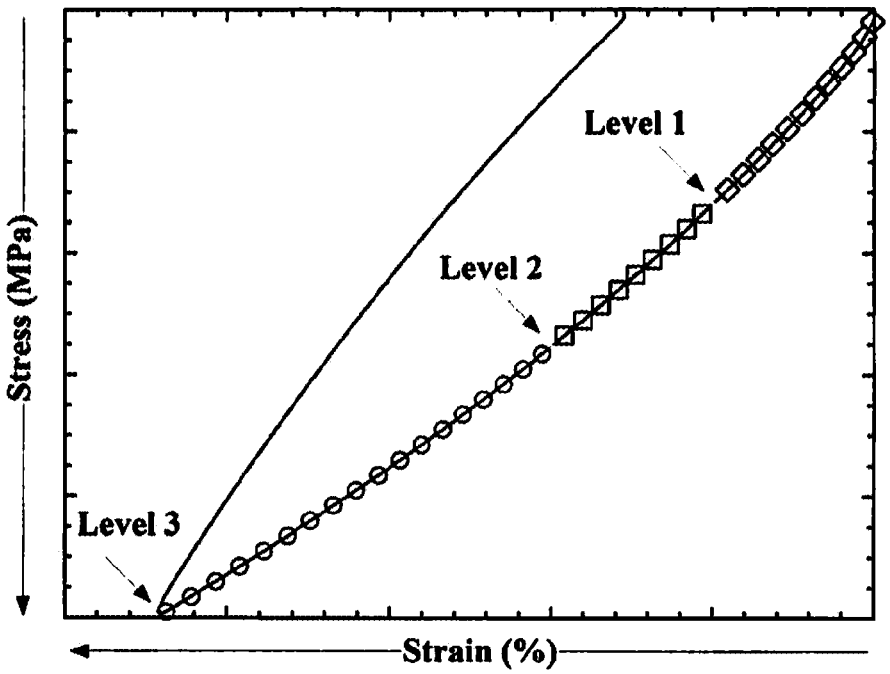
FIG. 11 is a graph illustrating the isothermal training method where the SMA material is deformed in the martensite phase at room temperature to a specific strain level, according to an embodiment of the present invention.

Turning to FIG. 8, for example, a flow diagram 800 illustrating a process to isothermally train SMA material (or expanding element), according to an embodiment of the present invention, is shown. In this embodiment, the process begins at 805 with processing of the bulk SMA material in an acceptable form (e.g., rods, bars, billets, tubes, etc.), ageing times and temperatures, surface finish, and any other SMA material preparation requirement. At 810, the deformation mode is determined, i.e., tension, compression, torsion, or some combination thereof, and an element of appropriate geometry for the selected mode of use is prepared. At 815, the SMA material is deformed in the martensite phase at room temperature to a specific strain level. See, for example, graph 1100 of FIG. 11. At 820, strain level from step 815 is held constant before unloading.

Figure 12:
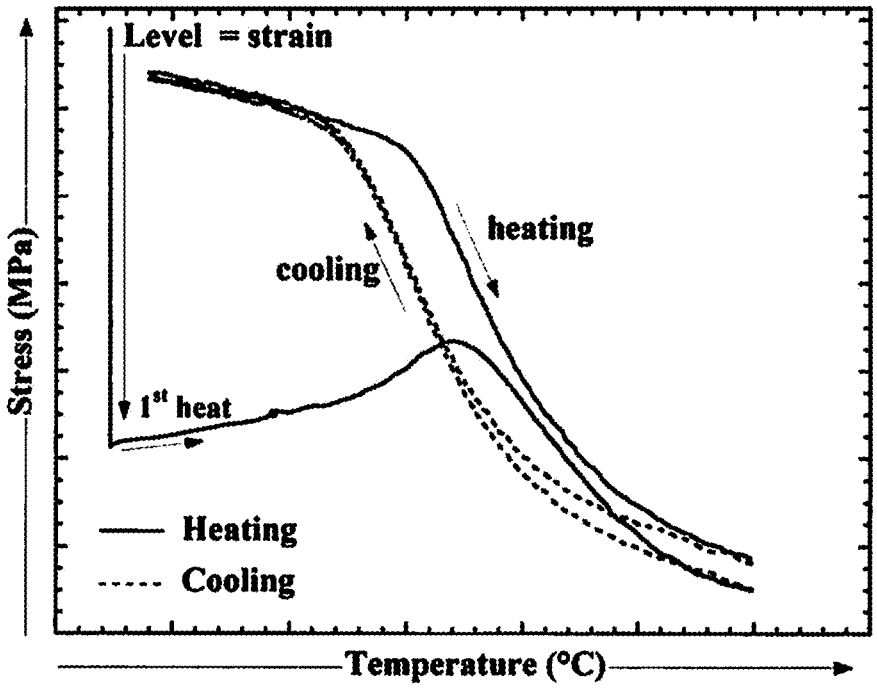
FIG. 12 is a graph illustrating the resultant stress generation after the isothermal training method, according to an embodiment of the present invention.

The effect of this training procedure on the blocking stress, which simulates the operation of the SMARS device after isothermal training, is determined by thermal cycling once the strain imposed at room temperature is held constant. At 825, for thermal cycling purposes, a lower cycle and upper cycle temperature is selected, e.g., 30° C. and 300° C. At 830, the SMA material is thermal cycled under the constant strain level between the lower and upper cycle temperatures. In some embodiments, the constant-strain thermal cycling portion may be repeated for multiple cycles. At 835, the stress generated with temperature is recorded, as shown, for example, in graph 1200 of FIG. 12. At 840, a determination is made as to whether maximum stress is achieved during temperature cycling (or sufficient for the desired applications). If not, the process returns to step 815; otherwise, the process is complete and the training is deemed appropriate for application in SMARS.

This process depends on the strain level reached in step 815 in order to achieve the desired microstructure (e.g., reoriented martensite phase) that yields optimum stresses when thermally cycled under constant-strain conditions. The strain levels also dictate the amount of displacement generated when the material is used in the SMARS application.

Figure 9:
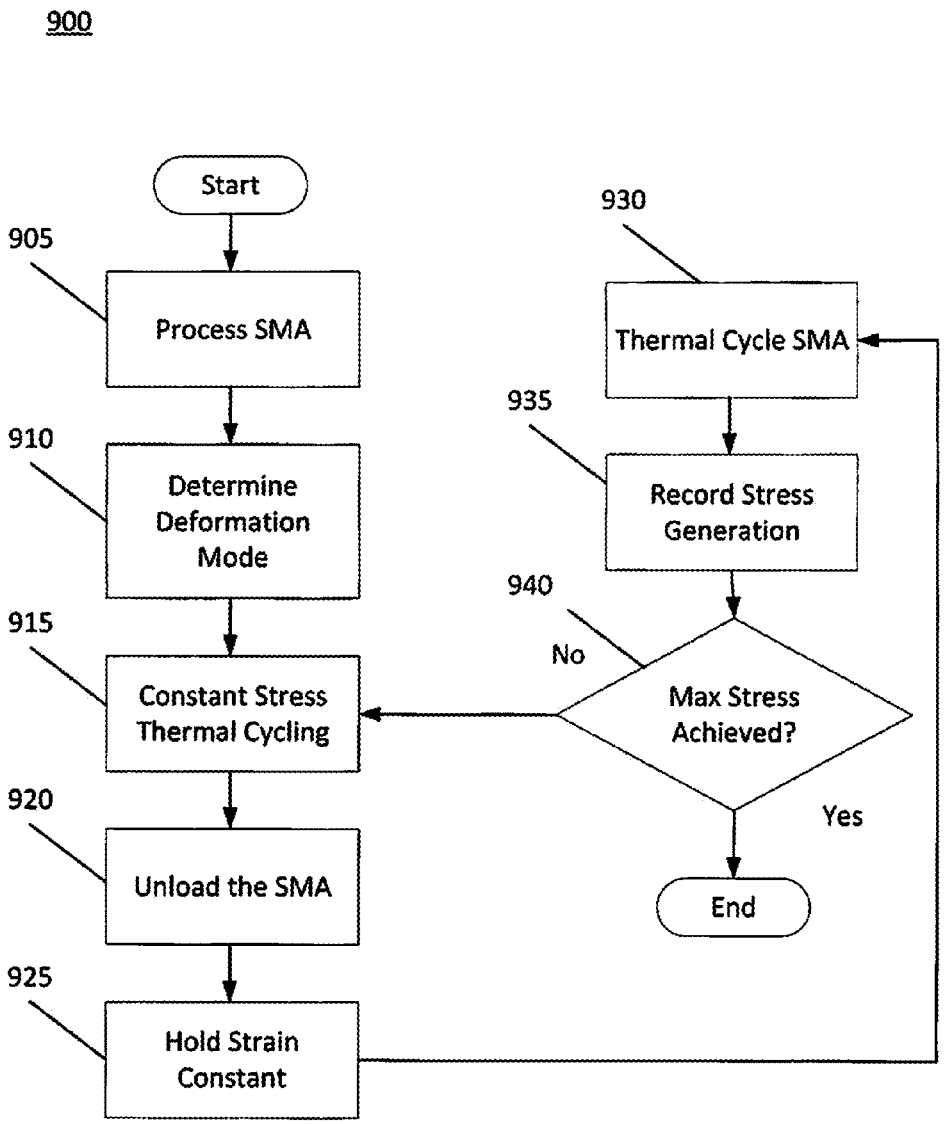
FIG. 9 is a flow diagram illustrating a process for isobarically training SMA material and verifying the stress capability, according to an embodiment of the present invention.
Figure 13:
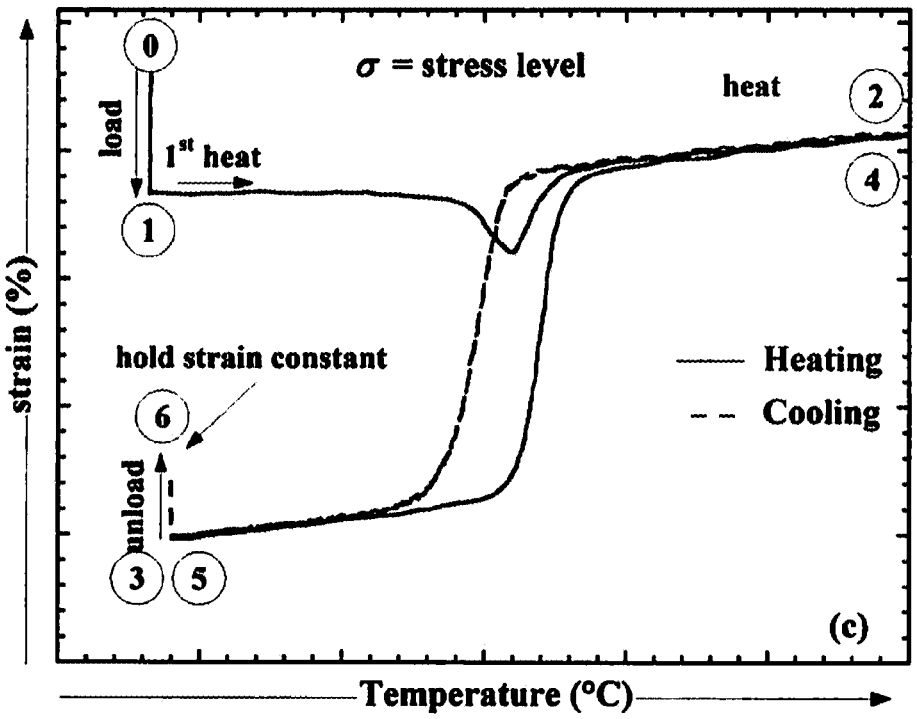
FIG. 13 is a graph illustrating the isobaric training method where the SMA material is thermomechanically cycled under a constant stress, according to an embodiment of the present invention.

FIG. 9 is a flow diagram 900 illustrating a process to isobarically train SMA material, according to an embodiment of the present invention. In this embodiment, the process begins at 905 with bulk processing of the SMA material in an appropriate form (e.g., rods, bars, billets, tubes, etc.), and at 910, the deformation mode is determined, i.e., tension, compression, torsion, or some combination thereof, and an element of appropriate geometry for the selected mode of use is prepared. At 915, the SMA material is thermomechanically cycled for one or more cycles under a constant stress, as shown, for example, in graph 1300 of FIG. 13. At 920, the SMA material may be unloaded to zero stress.

Figure 14:
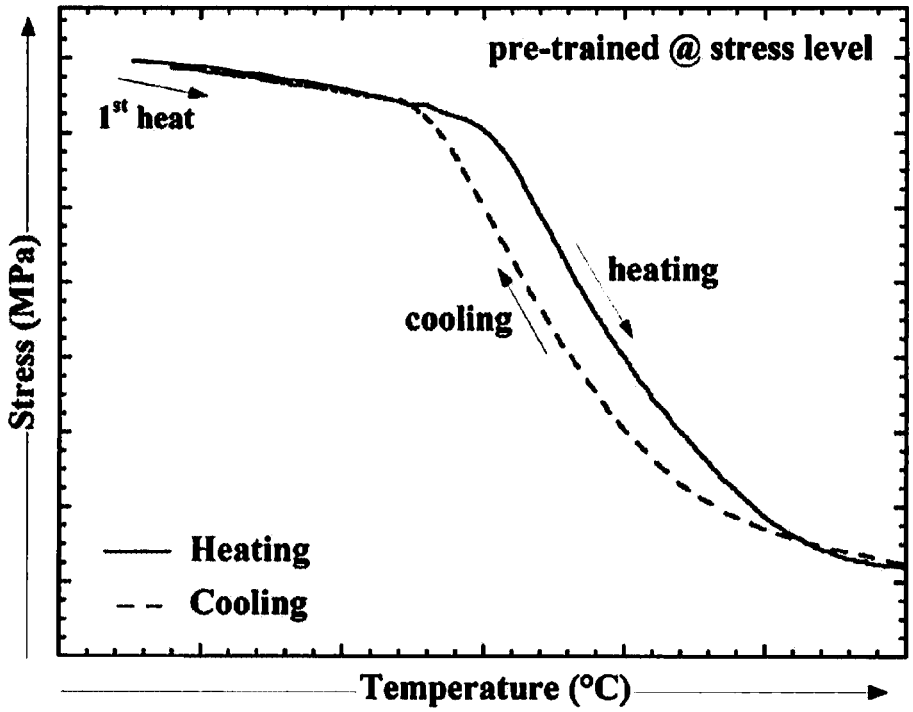
FIG. 14 is a graph illustrating the resultant stress generation after the isobaric training method, according to an embodiment of the present invention.

The effect of this training procedure on the blocking stress, which simulates the operation of the SMARS device after isobaric training, is determined by thermal cycling once the SMA material is fixed in strain at its new shape. At 925, the remnant strain on the SMA material is held constant while thermal cycling under constant strain condition. At 930, the SMA material is thermally cycled under a constant strain between a selected lower cycle temperature and upper cycle temperature, e.g., 30° C. and 300° C. At 935, the stress generation and the temperature are recorded, as shown in, for example, graph 1400 of FIG. 14. At 940, a determination is made as to whether maximum stress is achieved during temperature cycling. If not, the process returns to step 915; otherwise, the process is complete and the training is deemed appropriate for application in SMARS.

This process serves to texture the material at much lower training stresses when compared to the isothermal training. This is advantageous in cases where resetting or retraining the SMA material in the field of operations where large force equipment cannot be used.

Figure 10:
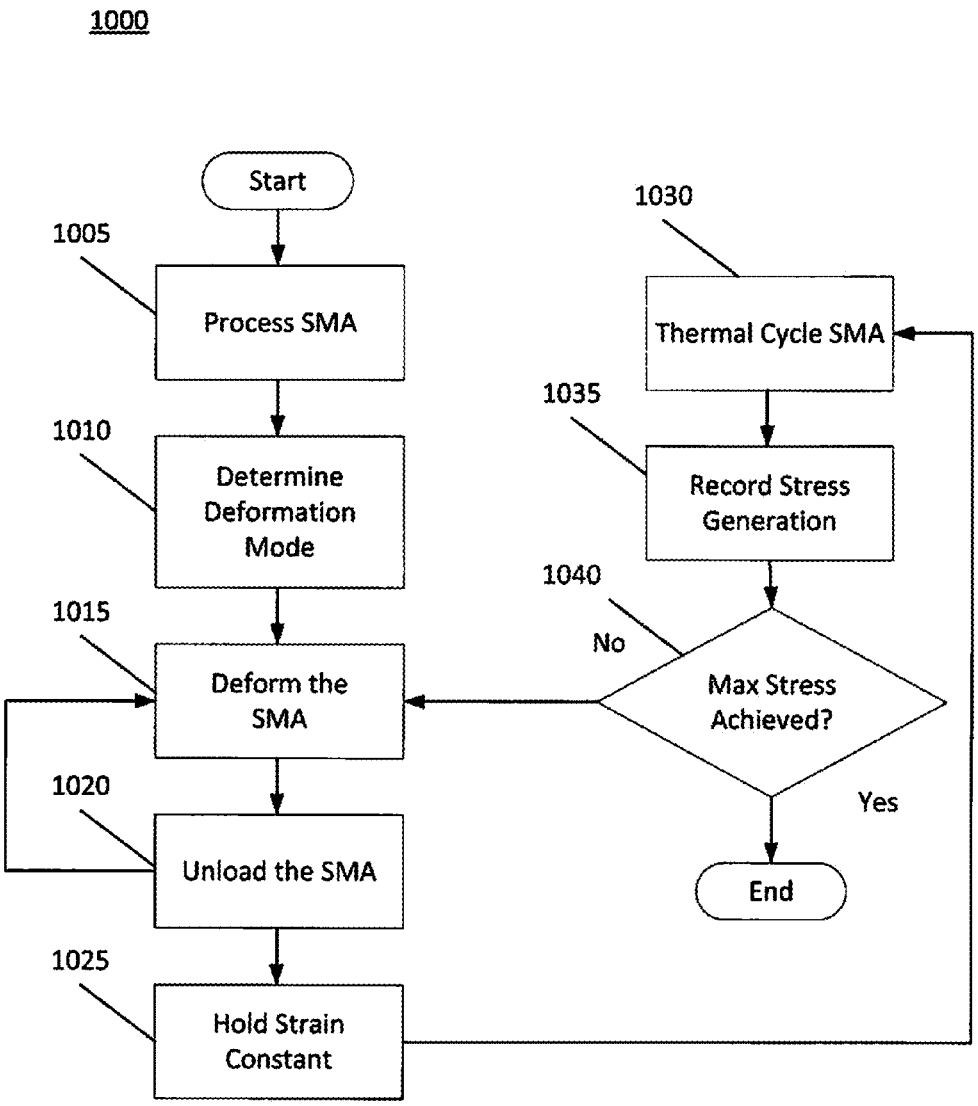
FIG. 10 is a flow diagram illustrating a process for cyclically training SMA material and verifying the stress capability, according to an embodiment of the present invention.
Figure 15:
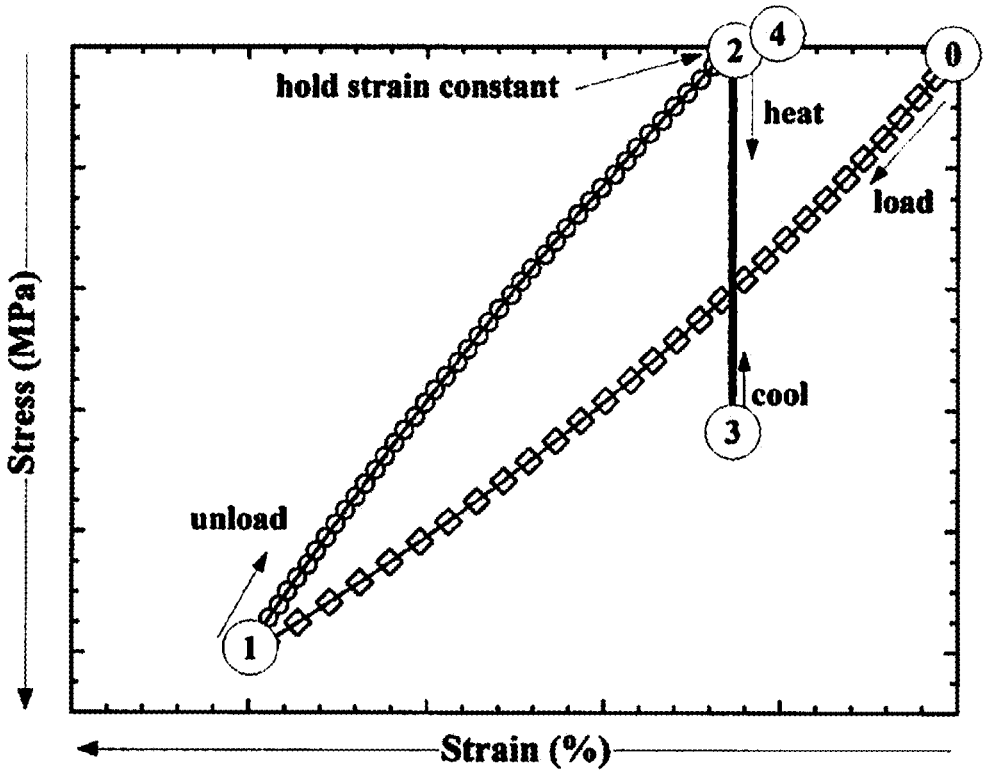
FIG. 15 is a graph illustrating the cyclic training method where the SMA material is deformed in the martensite phase and unloaded to zero stress, according to an embodiment of the present invention.

FIG. 10 is a flow diagram 1000 illustrating a process to cyclically train SMA material, according to an embodiment of the present invention. It should be appreciated that this process relates to the ability to reuse or retrain the SMA materials for SMARS operation. In this embodiment, the process begins at 1005 with processing the SMA material in an appropriate form (e.g., rods, bars, billets, tubes, etc.), and at 1010, determining the deformation mode of the SMA material, i.e., tension, compression, torsion, or some combination thereof, and an material of appropriate geometry for the selected mode of use is prepared. At 1015, the SMA material is deformed in the martensite phase at room temperature to a specific stress value. At 1020, the SMA material is unloaded to zero stress, as shown in, for example, graph 1500 of FIG. 15. At this point, the SMA material may be reloaded, such that step 1015 is repeated.

Figure 16:
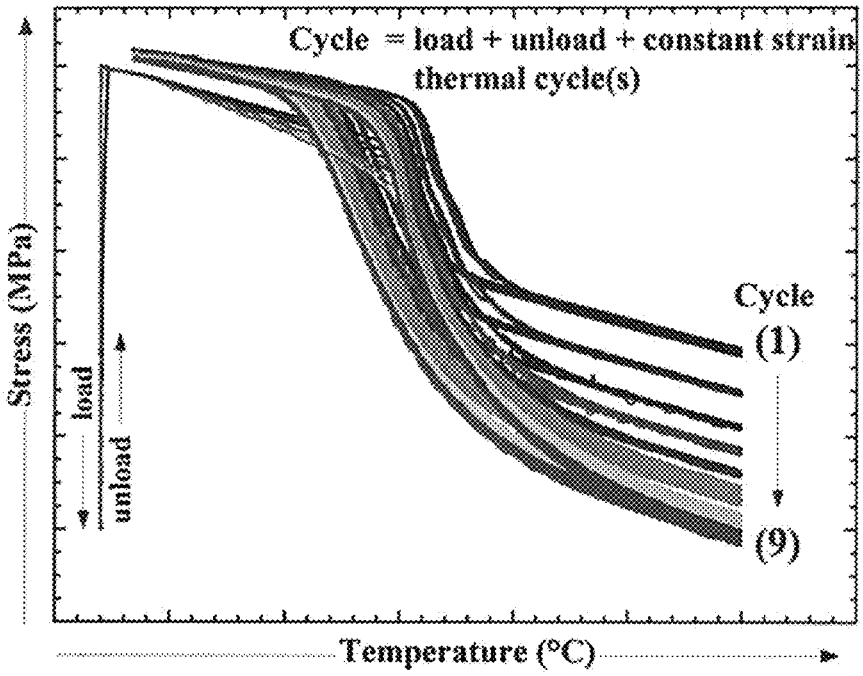
FIG. 16 is a graph illustrating the resultant stress generation after the cyclic training method, according to an embodiment of the present invention.

The effect of this training procedure on the blocking stress, which simulates the operation of the SMARS device after cyclic training, is determined by thermal cycling once the SMA material is fixed in strain. At 1025, the remnant strain may be held constant, and at 1030, the SMA material is thermally cycled under the constant strain. At 1035, the stress generation and the temperature are recorded, as shown in, for example, graph 1600 of FIG. 16. At 1040, a determination is made as to whether maximum stress is achieved. If not, the process returns to step 1015; otherwise, the process is complete and the training is deemed appropriate for application in SMARS. This process is more applicable to resetting the SMA material after use and still obtaining similar or even higher stresses.

It should be appreciated that the training process may be applied not only to NiTiHf or NiTiZr alloys, but also apply to other SMA material and other compounds and formulations.

Upon completion of the training or conditioning of SMA material, the SMA material may exist in a low temperature martensite phase. Returning back to FIG. 1, during the martensite phase, end caps 110 may be mechanically attached or directly machined on trained expanding element 105, i.e., the SMA material. In certain embodiments, the effective length of end caps 110 from tip to tip is made equal to a pre-drilled borehole diameter for proper operation. In other words, the width of expanding element 105 including end caps 110 is the same size as the pre-drilled hole in the rock, for example.

SMARS system 100 may also include a heater 115 that includes one or more expanding elements 105. Heater 115 may include one or more sleeves 120 allowing one or more SMA expanding element 105 to be inserted within each sleeve 120. In some embodiments, sleeve 120 may be made of metal. An adhesive cement 125 may surround sleeve 120 to prevent heater 115 from degradation. Power, such as direct current (DC) or alternating current (AC), may be connected to a heater 130, which are wrapped around metal sleeve 120. When heater 115 is inserted into a pre-drilled hole within a rock or a crack, theheater 130 in some embodiments may supply heat to expanding elements 105 causing expanding elements 105 to expand after reaching certain temperatures.

It should be appreciated that various types of heating systems may be used for SMARS system 100. As discussed above, in one embodiment, a metallic sleeve 120, adhesive cement 125, and conductive wires 130 may be housed within in heater 115. This may provide a compact heater capable of heating to temperatures exceeding 400° C. in a relatively short period of time. In some embodiments, this may be seconds to one minute. In another embodiment, heaters may be wrapped around and bonded to the expanding elements 105. In a further embodiment, induction heating may be used to heat expanding elements 105. This may be used for large, dry boreholes. Induction heating may yield fast heating rates, but may require a much higher power consumption (e.g., 120 VAC) and footprint (a separate power supply is needed to power the induction unit).

In some embodiments, a control box 135 may deliver a power signal to the heater 115. During operation, expanding elements 105 may undergo a phase transformation to the high temperature austenite phase. In this phase, expanding element may go to an unconstrained condition, i.e., expansion in this case. However, since expanding elements 105 are confined by the wall constraints within the borehole, expanding elements 105 may not initially expand, and instead exert forces at the contact area resulting in rock fracture. After the rock is split, expanding elements 105 may be retrained to the constrained condition. Expanding elements 105 may be reused for successive employments in some embodiments given that new expanding elements 105 may be used, or in other embodiments, same expanding elements 105 may be re-trained.

Figure 7:
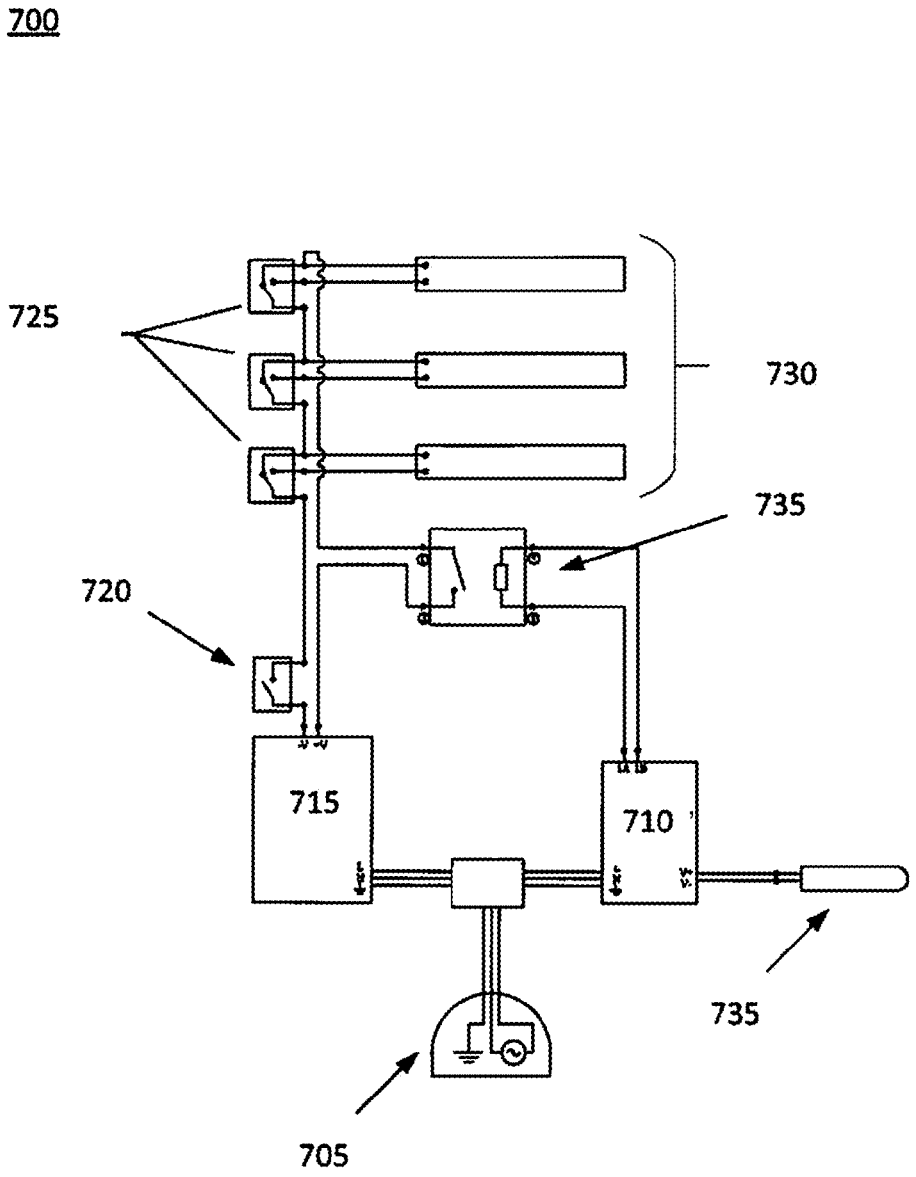
FIG. 7 is a circuit diagram illustrating a control system for SMARS, according to an embodiment of the present invention.

It should be appreciated that control box 135 in this embodiment may include a temperature indicator with retransmission, a power supply, selector switches to trigger the individual heaters either simultaneously or sequentially, connectivity for type-K thermocouples, and a main power switch to activate the chosen heaters. See, for example, FIG. 7, which is a circuit diagram 700 illustrating a control box for the SMARS system, according to an embodiment of the present invention.

The control box includes a power input 705 to energize a temperature controller 710 that monitors the temperature of heaters 730. The control box also includes a direct current (DC) power supply 715 to energize the main power switch 720, and to provide heating to the SMA elements. The control box in some embodiments includes heater selecting switches 725 that activates one or more heaters 730.

Temperature controller 710 and thermocouples 740 may monitor the temperature of heaters 730. Solid-state relay 735 may be used to modulate or regulate the power coming out of power supply 715.

Figure 3:
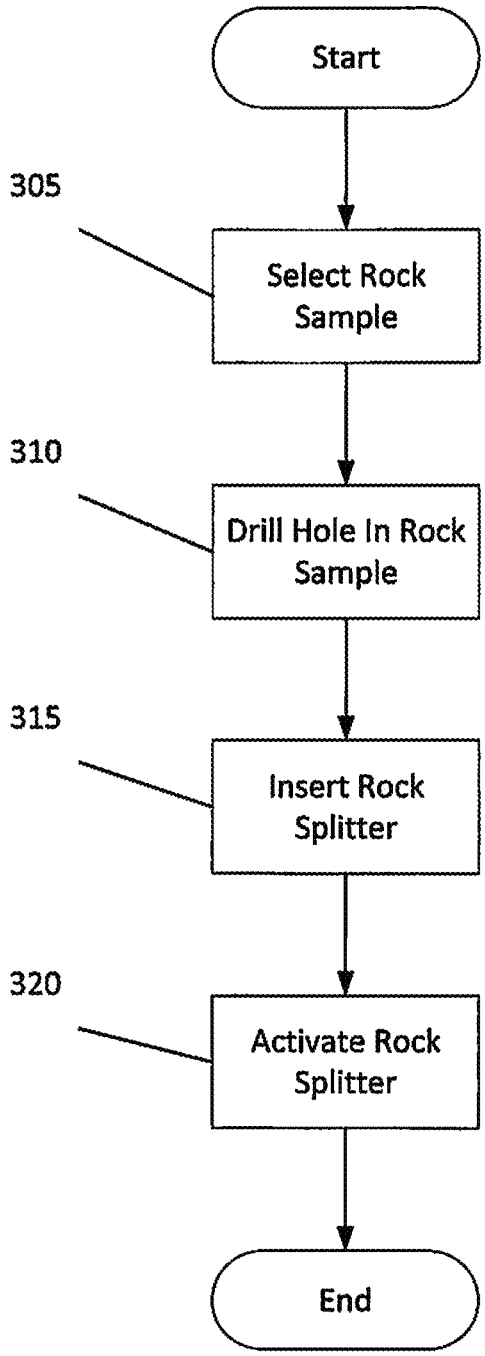
FIG. 3 is a flow diagram illustrating a process for activating SMARS, according to an embodiment of the present invention.

Turning to FIG. 3, a flow diagram 300 illustrating a process for activating SMARS is shown, according to an embodiment of the present invention. In this embodiment, the process begins at 305 with a rock sample or crack being selected. This rock sample or crack may be on Earth, on another planet, asteroid, etc. At 310, the bore hole is drilled in the selected rock sample, and at 315, the rock splitter is inserted in the bore hole. At 320, the rock splitter, which includes the expanding elements, is activated causing the expanding elements to split the rock.

Figure 4:
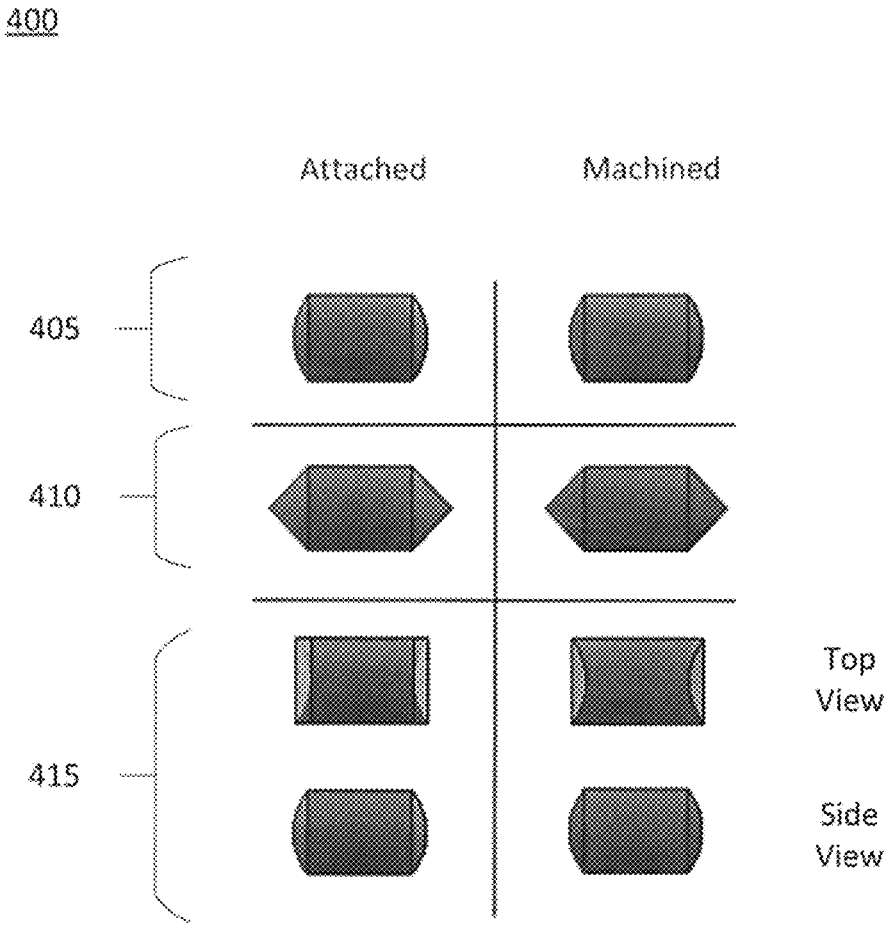
FIG. 4 illustrates SMARS end caps, according to an embodiment of the present invention.

FIG. 4 illustrates SMARS end caps 400, according to an embodiment of the present invention. As discussed above, end caps may be attached to SMA expanding elements. Depending on the configuration, the end caps may be mechanically attached, machined on, or bonded to, the SMA expanding element. For example, different types of end caps may directly attach to the SMA expanding element depending on the rock types or the hardness of the rock, and also to compensate for any gaps between SMA expanding element and the rock surface. As shown in FIG. 4, several types of end caps may be used, e.g., spherical 405, conical 410, and cylindrical 415. In some embodiments, flat ends may also be attached to SMA expanding element.

The flat ends may be utilized for plane borehole walls or pre-existing cracks in the vicinity of the rock of interest. The conical ends may be used for acute penetration into the rocks to help with the crack initiation and ultimately propagation to fracture. Both the spherical and cylindrical ends may be used for maximizing the contact surface area within the borehole. In these cases, the end tip forms may be machined to match the borehole diameter.

Figure 5A:
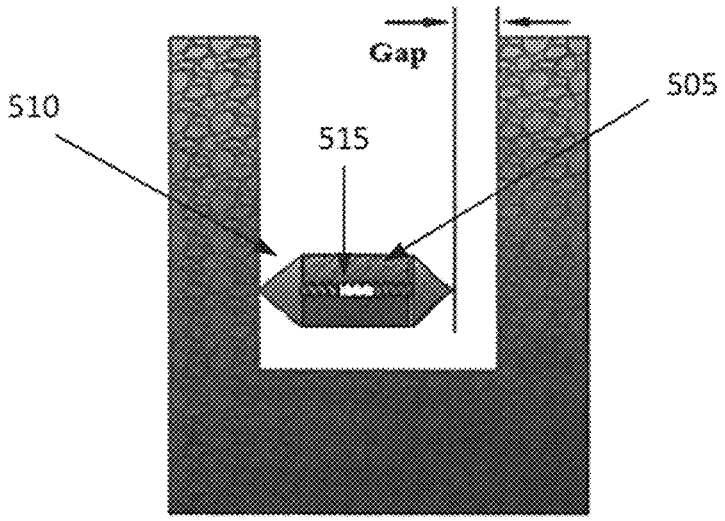
FIGS. 5A and 5B illustrate adjustable tips for SMARS, according to an embodiment of the present invention.
Figure 5B:
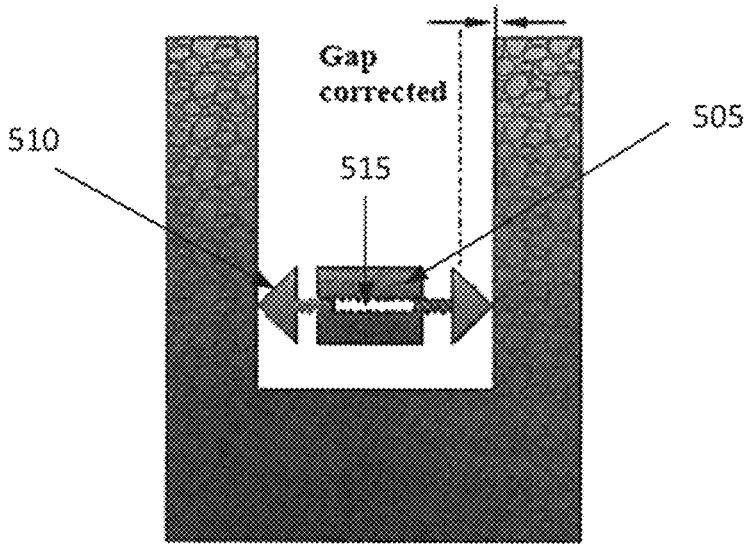

FIGS. 5A and 5B illustrate adjustable tips for SMARS 500, according to an embodiment of the present invention. In this embodiment, a SMA expanding element 505 with end caps 510 is inserted within a hole. As shown in FIG. 5A, a gap exists between one end cap 510 and the wall of the hole in the rock. To compensate for this gap, or to provide a gap correction, cap 510 may be unscrewed. SMA expanding element 505 may then be activated to expand and exert force on the wall of the hole in order to split the rock.

FIGS. 6A-6D illustrates SMARS pusher 600, according to an embodiment of the present invention. In some embodiments where complete splitting is required, SMA pusher 600 can provide additional displacement after the SMA expanding element has been activated. Pusher 600 may be made in the form of helical springs, which includes grooves 605, and may be placed on the top position of the sample holder 115. See, for example, FIG. 1. In one embodiment, pusher 600 may be heated sequentially after the bottom and/or middle SMA expanding member in the heater is fully expanded to completely split the fractured rock. In other words, pushers 600 may provide additional displacements to fully split the rock in additional embodiments.

Figure 6A:
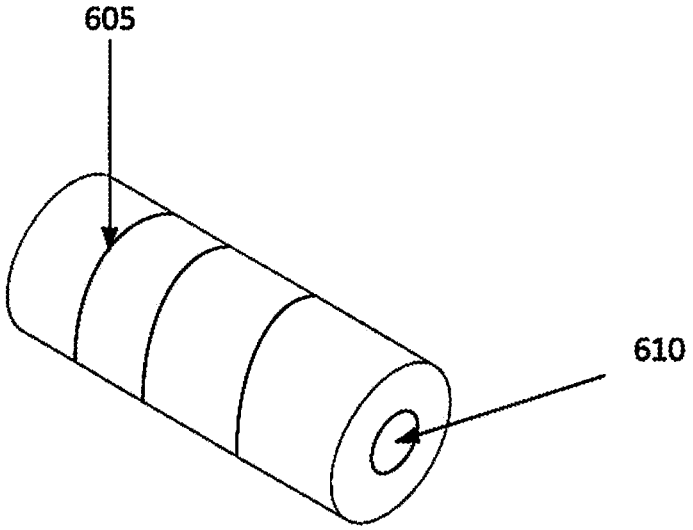
FIGS. 6A-6D illustrates SMARS pusher, according to an embodiment of the present invention.
Figure 6B:
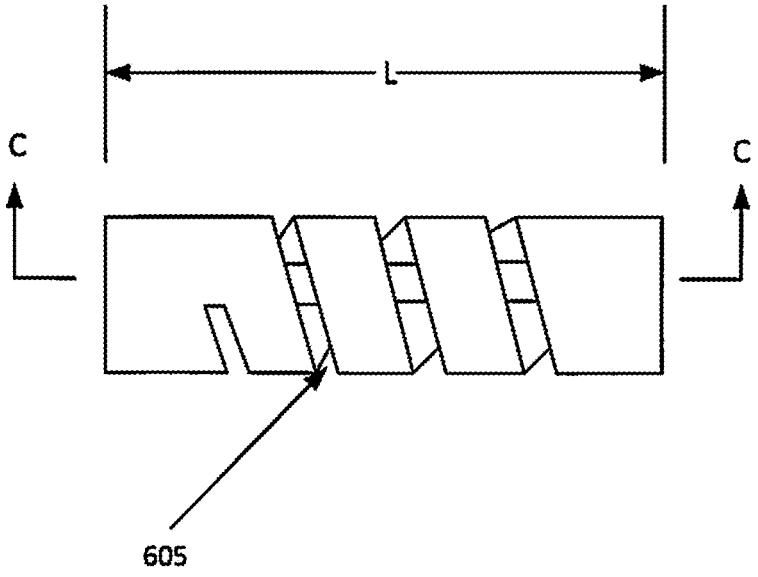
Figure 6C:
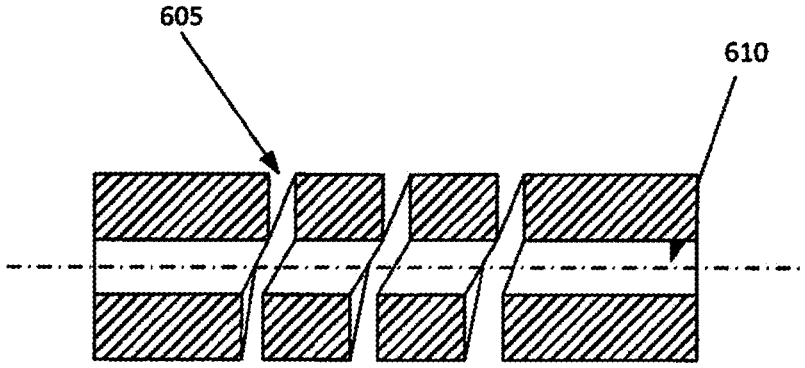
Figure 6D:
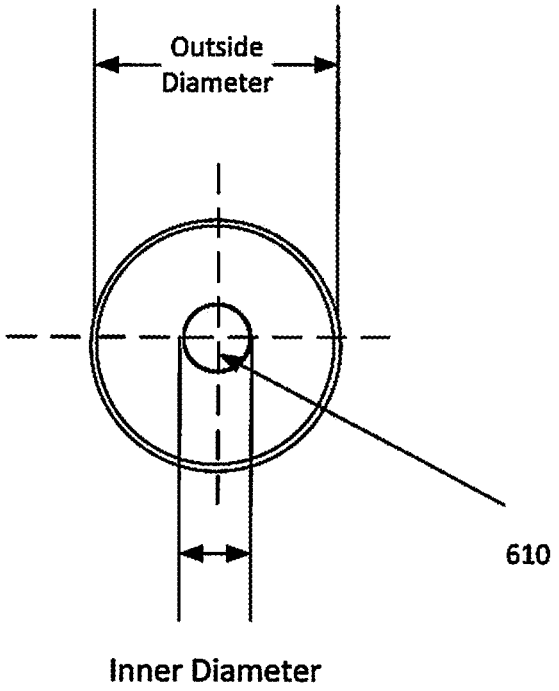

Pusher 600 may have a predefined length L, and include an inner hole 610 to allow an end cap (not shown) to be inserted within pusher 600. See, for example, FIGS. 6A-6D. As shown in FIG. 6D, rod 600 has an outer diameter OD and an inner diameter ID for inner hole 605.

Pusher 600 provides additional displacement, but at generally lower stresses than the expanding elements. Its purpose is to finish fracturing the rock once the expanding elements have initiated fracture. Thus, if the displacements (or strains) imparted by the training methods are not sufficient to completely split the rock, SMA pushers 600, which can also be trained using the aforementioned methods, may provide additional controlled displacement for a compete rock splitting.

SMARS, in one or more embodiments, is a static device that provides controllable motion without any demolition damage to the surrounding environment, compared to the alternative dynamic explosive, blasting approaches, or high impact approaches. This characteristic makes the SMARS ideal for critical planetary rock breaking and/or sampling operations, where flying debris from blasts/explosion methods can destruct the rock formation of interest, pose safety concerns to the crew, and cause damage to the costly nearby equipment, e.g., rover mirrors and sensors. In addition, static SMARS may require little setup and activation time compared to other static methods, such as chemical agents, that can take up to days to react with some hard rocks. Mission reliability is another benefiting factor since SMARS operate based on a material response and may only require heat input to activate without the need for complex valve systems and hydraulic fluids. This makes SMARS extremely simple and essentially user friendly during operation. The small volume and extremely low weight of the SMARS reduces payload launch costs and transportation hazards when compared to heavy hydraulic wedges and dangerous explosive materials and chemicals. SMARS may also be dust and vibration free during operation, and further does not disturb nearby instruments conducting simultaneous tasks.

Although the SMARS device is targeted for static rock breaking in space related explorations, it is readily understood that SMARS can also be used in non-rock related applications such as a proppant or spacers to unjam a trapped component. The SMARS device development can also be extended in some embodiments to the applicability of ground-based systems such as oil drilling, mining, fossil collecting and retrieval of other fragile geologic samples, proppants, civil engineering and other fields requiring compact but large static forces. The SMARS device can also be used for structure reinforcement and corrective force applications to structural members and other engineering components. The SMARS device is also envisioned for applications requiring smooth and controlled cracking and/or splitting such as in the military applications where quiet and explosive free operation is generally sought.

It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus for splitting rock, comprising:

one or more shape memory alloy expanding elements comprising nickel titanium hafnium (NiTiHf), nickel titanium zirconium (NiTiZr), or nickel titanium hafnium zirconium (NiTiHfZr), wherein when the one or more shape memory alloy expanding elements reach a predefined temperature within a predefined borehole of the rock, the one or more shape memory alloy expanding elements are configured to exert force on walls of the borehole for splitting the rock; and adjustable end tips configured to enhance cracking of the rock and compensate for irregularity in a borehole diameter.

2. The apparatus of claim 1, wherein the one or more shape memory alloy expanding elements comprise a temperature capability of at least 100 degrees Celsius.

3. The apparatus of claim 1, wherein the one or more shape memory alloy expanding elements comprise a stress capability of at least 800 MPa.

4. The apparatus of claim 1, wherein the one or more shape memory alloy expanding elements comprise a stress capability of at least 1000 MPa.

5. The apparatus of claim 1, wherein the adjustable end tips comprises one or more shapes depending on rock type being explored.

6. The apparatus of claim 1, wherein the adjustable end tips are machined directly onto the shape memory alloy expanding elements.

7. The apparatus of claim 1, wherein the adjustable end tips are independent to the shape memory alloy expanding elements.

8. The apparatus of claim 1, further comprising:

one or more pushers configured to provide additional displacement at a relatively lower stress after the shape memory alloy expanding elements have been activated.

9. The apparatus of claim 8, wherein the one or more pushers comprise a specific amount of weight required to deflect the material per unit length, or spring rate, to achieve a desired final splitting.

10. The apparatus of claim 1, further comprising:

a heater housing the one or more shape memory alloy expanding elements is configured to heat the one or more shape memory alloy expanding elements within the predefined borehole of the rock.

11. The apparatus of claim 10, wherein the heater comprises one or more sleeves to house the one or more shape memory alloy expanding elements.

12. The apparatus of claim 11, wherein the heater comprises adhesive cement surrounding the one or more sleeves.

13. The apparatus of claim 11, wherein the heater comprises heater wrapped around the one or more sleeves.

14. The apparatus of claim 10, wherein, when the heater is placed within the predefined borehole of the rock, the heaters are configured to supply heat to the one or more shape memory alloy expanding elements causing the one or more shape memory alloy expanding elements to expand after reaching predefined temperature.

15. A process for training shape memory alloy material, comprising:

determining a deformation mode of the shape memory alloy material; and based on the deformation mode, isothermally training the shape memory alloy material to a predefined strain level required to obtain a desired stress and displacement, isobaric training the shape memory alloy material to the predefined stress level, or cyclic training the shape memory alloy material to the predefined stress levels.

16. The process of claim 15, wherein the shape memory alloy material comprises nickel titanium hafnium (NiTiHf), nickel titanium zirconium (NiTiZr), or nickel titanium hafnium zirconium (NiTiHfZr).

17. The process of claim 15, wherein the isothermally training of the shape memory alloy material comprises:

deforming the shape memory alloy material to the predefined strain level;

maintaining the predefined strain level of the shape memory alloy material; and thermal cycling the shape memory alloy material under the predefined strain level between a lower temperature cycle and an upper temperature cycle.

18. The process of claim 15, wherein the isobaric training the shape memory alloy material comprises:

thermomechanically cycling the shape memory alloy material for one or more cycles at a constant stress;

unloading the thermomechanically cycled shape memory alloy material to zero stress;

holding a remnant strain constant on the unloaded shape memory alloy material; and thermal cycling the shape memory alloy material under the constant remnant strain between a lower temperature cycle and an upper temperature cycle.

19. The process of claim 15, wherein the cyclic training of the shape memory alloy material comprises:

deforming the shape memory alloy material in a martensite phase to the predefined stress level;

unloading the shape memory alloy material to zero stress;

holding constant a remnant strain level on the shape memory alloy material; and thermally cycling the shape memory alloy material under the constant remnant strain level.

* * * * *